US011273945B2

(12) United States Patent
Männle et al.

(10) Patent No.: US 11,273,945 B2
(45) Date of Patent: Mar. 15, 2022

(54) METHOD AND DEVICE FOR APPLYING ADDITIVE PACKAGING MATERIAL

(71) Applicant: SIG Technology AG, Neuhausen am Rheinfall (CH)

(72) Inventors: Andreas Männle, Singen (DE); Daniel Hirt, Klettgau (DE); Joachim Bührer, Stuehlingen (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 73 days.

(21) Appl. No.: 16/607,383

(22) PCT Filed: Apr. 23, 2018

(86) PCT No.: PCT/EP2018/060331

§ 371 (c)(1),
(2) Date: Oct. 23, 2019

(87) PCT Pub. No.: WO2018/197407

PCT Pub. Date: Nov. 1, 2018

(65) Prior Publication Data

US 2020/0130880 A1 Apr. 30, 2020

(30) Foreign Application Priority Data

Apr. 27, 2017 (DE) ..... 10 2017 109 121.1
Apr. 27, 2017 (EP) ..... 17020177

(51) Int. Cl.
*B65B 61/20* (2006.01)
*B65B 35/24* (2006.01)
*B65D 77/28* (2006.01)

(52) U.S. Cl.
CPC ..... *B65B 61/205* (2013.01); *B65B 61/207* (2013.01); *B65B 35/24* (2013.01);
(Continued)

(58) Field of Classification Search
None
See application file for complete search history.

(56) References Cited

U.S. PATENT DOCUMENTS 4,293,369 A * 10/1981 Dilot ..... B65B 61/205 156/521
4,372,797 A * 2/1983 Dilot ..... B65B 61/205 156/249

(Continued)

FOREIGN PATENT DOCUMENTS

CN 1274325 A 11/2000
CN 102470995 A 5/2012

(Continued)

*Primary Examiner* — Hemant Desai
*Assistant Examiner* — Tanzim Imam
(74) *Attorney, Agent, or Firm* — The Webb Law Firm

(57) ABSTRACT

Presented and described are a device for separately applying additive packaging material, preferably wrapped straws, supplied as an additive packaging material continuous belt, to packages, in particular cardboard composite packages, having a separating organ for separating the additive packaging material of the additive packaging material continuous belt, a supply means for supplying the additive packaging material continuous belt to the separating organ and for relaying the additive packaging material separated by the separating organ, an application means for applying the separated additive packaging materials to the packages and a transport means for transporting the packages along a package transport path to the application means. So that the separation and application of the additive packaging materials can be carried out quickly, with high quality and reliably, it is provided that a transfer means is provided for picking up the additive packaging material relayed from the supply means and for accelerating the transferred additive packaging material to a speed adapted to the application means.

15 Claims, 6 Drawing Sheets

(52) U.S. Cl.
CPC ..... *B65B 61/202* (2013.01); *B65B 2220/14* (2013.01); *B65B 2220/18* (2013.01); *B65D 77/28* (2013.01)

(56) References Cited

U.S. PATENT DOCUMENTS

| | | | | |
|---|---|---|---|---|
| 4,584,819 | A | 4/1986 | Hakansson | |
| 4,969,308 | A * | 11/1990 | Hakansson | B65B 61/205 53/133.1 |
| 5,037,366 | A * | 8/1991 | Yokoyama | B65B 61/205 493/84 |
| 6,282,865 | B1 | 9/2001 | Bergstrom et al. | |
| 6,526,725 | B1 * | 3/2003 | Williams | B65B 61/205 493/379 |
| 2010/0000627 | A1 * | 1/2010 | Lecointe | B29C 66/80 141/18 |
| 2012/0090954 | A1 | 4/2012 | Krauss et al. | |
| 2012/0227906 | A1 * | 9/2012 | Basgil | B65B 51/023 156/357 |

FOREIGN PATENT DOCUMENTS

| | | | |
|---|---|---|---|
| CN | 105501561 | A | 4/2016 |
| DE | 2902899 | A1 | 8/1979 |
| DE | 3824013 | A1 | 1/1990 |
| DE | 4114191 | C1 | 4/1992 |
| DE | 10056115 | A1 | 5/2002 |
| EP | 0350590 | A1 | 1/1990 |
| EP | 1042172 | B1 | 4/2004 |
| JP | 60172627 | A | 9/1985 |

* cited by examiner

METHOD AND DEVICE FOR APPLYING ADDITIVE PACKAGING MATERIAL

This application is the United States national phase of International Application No. PCT/EP2018/060331 filed Apr. 23, 2018, and claims priority to German Patent Application No. 10 2017 109 121.1 and European Patent Application No. 17020177.6, both filed Apr. 27, 2017, the disclosures of which are hereby incorporated by reference in their entirety.

BACKGROUND OF THE INVENTION

Field of the Invention

The invention relates to a device for separately applying additive packaging material, preferably wrapped straws, supplied as an additive packaging material continuous belt, to packages, in particular cardboard composite packages, having a separating organ for separating the additive packaging materials of the additive packaging material continuous belt, a supply means for supplying the additive packaging material continuous belt to the separating organ and for relaying the additive packaging materials separated by the separating organ, an application means for applying the separated additive packaging materials to the packages and a transport means for transporting the packages along a package transport path to the application means. The invention also relates to a method for separately applying additive packaging material, preferably wrapped straws, supplied as an additive packaging material continuous belt, to packages, in particular cardboard composite packages.

DESCRIPTION OF RELATED ART

Packaged goods are packed by means of packages. Together, a packaged good and packaging form a package. For filling and packaging in particular flowable products, such as drinks or other foodstuffs, in addition to bottles and cans, composite packages are also used. Composite packages are formed of packaging materials connected to one another. Cardboard composite packages also comprise, in addition to cardboard packaging material, plastic packaging material, for example. Cardboard and plastic are connected to one another along their planes and form a so-called packaging laminate as a layer structure. The cardboard layer gives the package stability and serves as a carrier layer for plastic layers. Plastic layers serve, among other things, as liquid barriers so that packaged goods such as flowable products, for example drinks, can be filled and so that no moisture can penetrate the cardboard layer from the outside. Furthermore, plastic layers can be sealed as thermoplastic layers. For example, firmly bonded sealing seams for forming the packaging and sealing the package are possible. The layer construction of the packaging laminate may vary depending on requirements. For example, for aseptic filling goods, an additional aluminium layer is inserted to achieve a good barrier effect against gases and light. To be able to fold the sheet-like packaging laminate, i.e. to be able to fold it by machine, creases are often introduced into the packaging laminate. Creases define the later fold lines. The folds form the packaging edges on the package and/or facilitate the shaping of the bottom and/or top of the package. Most packaging laminates are also printed with a decor.

Often—but not always—the packaging laminate is already cut to a packaging interval during its production. Such blanks may be further processed into so-called packaging sleeve blanks. Thus, the blank is folded down and connected to a tube by a longitudinal sealing seam. Such packaging sleeve blanks form the actual packaging material of a cardboard composite package. Alternatively, the packaging laminate may be provided as a continuous material, in particular as a roller.

The actual shaping and filling of the packaging and the sealing into a package is carried out in a packaging machine which is also frequently referred to as a forming/filling/sealing machine based on its main functions, specifically forming the packaging, filling the packaging and sealing the packaging. Filling goods are predominantly liquid foodstuffs such as drinks, soups or yoghurt. Set, clotted, pasty and lumpy products or flowable products with lumpy portions, which may also preferably be foodstuffs, are also conceivable. In the case of drinks, cardboard composite packages are also referred to as drinks carton composite packages.

Packages of the above-mentioned type are sometimes also provided with additive packaging material such as pouring elements and/or straws, which are also referred to as drinking straws. The latter are generally—to ensure the required hygiene—incorporated in sealed outer packaging. The additive packaging materials may be glued to the side wall of a cardboard composite package by means of hot glue, for example. If the consumer wants to consume the product with a straw, they first remove the wrapped straw from the side wall of the package, in particular the cardboard composite package, and take it out of the outer packaging. The unwrapped straw can then at the sharpened end be forced into a specially weakened area in the package, in particular the cardboard composite package, so that the product can be directly consumed through the straw.

As mass-produced products, additive packaging materials are commercially available as continuous belts. An additive packaging material continuous belt is generally constructed from a plurality of additive packaging materials connected to one another in the belt direction, from which in turn additive packaging materials are separated or isolated and then applied to the packages. In the case of straw continuous belts, these are formed, for example, by straws aligned transversely to the belt direction and shrink-wrapped in film. The film thus forms both the respective outer packaging of the straw as well as—in sequence—the "continuous" belt.

For the machine separation and application of the wrapped straws on cardboard composite packages, for example, devices according to DE 29 02 899 A1 are used. In this case, the straw continuous belt is fed from a supply roll over deflecting rollers into a cyclically driven supply means to supply the continuous belt to a separating organ for separating the straws and to relay the separated straws to an application means. The wrapped straws are separated in the supply means by means of a bidirectionally movable cutting blade and passed on further in the direction of the application point. In the meantime, the filled and sealed cardboard composite packages are provided with adhesive from a transport means along a linear transport path and supplied to an application means. From the application means, the separated straws are applied to the supplied packages at the application point by means of a transfer element. The cycling of the supply means facilitates a separation of the straws when they stand still. However, this cyclic procedure often limits the processing speeds.

European patent EP 1 042 172 B1 proposes a device for attaching wrapped straws to cardboard composite packages, wherein the continuous belt is supplied to a continuously rotating supply means, where the separation of the straws from the continuous belt is completed by separating the continuous belt by means of a separating means. The supply means first supplies the continuous belt in order then to separate the straws by means of a separating means in the form of a cutting blade. In addition to a radial puncturing movement in the direction of the drive means axis of rotation, the cutting blade additionally performs a tracking movement over a certain peripheral portion of the supply means. The straws separated in this way are relayed on an application means in the form of an additionally continuously moving application fork, from where the straws are pressed onto the packages which have been previously provided with adhesive and led along a transport path via a transport means. Separating means running partially around the periphery of the supply means are mechanically complex and relatively prone to failure. Often, they also produce unsatisfactory cutting results such as protruding separating burrs or similar.

The object of the present invention is therefore to design and refine a device and a method of the type referred to at the outset and previously described such that the described disadvantages can be overcome. In particular, the separation and application of additive packaging material should be carried out quickly, with high quality and reliably.

SUMMARY OF THE INVENTION

The object is achieved with a device in that a transfer means is provided for picking up the additive packaging material relayed from the supply means and for accelerating the picked up additive packaging material to a speed adapted to the application means.

The object of the invention is also achieved by a method, in which the following working steps are performed:

Supplying an additive packaging material continuous belt to a separating organ by means of a supply means, Separating the additive packaging material of the additive packaging material continuous belt on the supply means by means of a separating organ, Relaying the separated additive packaging materials by means of the supply means, Picking up and accelerating the separated additive packaging materials to a speed adapted to an application means by a transfer means, Delivering the accelerated additive packaging materials to the application means at a speed adapted to the application means, and Applying the additive packaging materials by means of the application means to packages moved past the application means along a package transport path by a transport means.

A transfer means interposed between the supply and application means facilitates a functional and structural decoupling of the separation of the additive packaging material from the additive packaging material continuous belt and the application of the separated additive packaging materials to the packages. Thus, the separation of the additive packaging materials and the application of the additive packaging materials to the packages is carried out at different speeds and speeds respectively adjusted according to requirements. In concrete terms, this means that e.g. cutting and separating processes can be carried out at lower speeds or even when the additive packaging material continuous belt is at a standstill, while the process of applying the separated additive packaging materials to the packages can be carried out at higher speeds. Speeds which are adaptable in this way lead to more stable and therefore more reliable working processes and higher finishing qualities. At the same time, the entire process can be accelerated. The transfer means as a bridging element also facilitates safe movement of the additive packaging material from the separation point to the application point, even at high application speeds.

For the sake of simplicity, the transfer means can pick up the separated additive packaging materials directly from the supply means and/or deliver them directly to the application means. The supply means and the application means are then coupled directly via the transfer means, so that further modules are unnecessary. This may also mean that the additive packaging material is picked up at one point, the pick-up position, of the delivery means, and delivered at another point, the delivery position, of the delivery means to the application means. Thus, the pick-up and delivery are preferably carried out one after another, in particular alternately, to be able to realise the pick-up and delivery at different speeds. In the meantime, the transfer means as a whole can be accelerated or decelerated. Alternatively, only one part of the transfer means can be decelerated and, as required, another part of the transfer means can be accelerated. In this case, carriers can be provided, for example, for receiving the additive packaging material which can be decelerated and accelerated independently of one another. The carriers are then, for example, decelerated before picking up the additive packaging material and accelerated before delivering the additive packaging material. If the transfer means is accelerated or decelerated as a whole, a so-called latent operation is a possibility. In this case, the transfer means can rotate slowly or even come to a stop and thus pick up an additive packaging material from the supply means. Then, the supply means can be accelerated to deliver the additive packaging material or another additive packaging material at a higher speed to the application means, after which the transfer means is decelerated again to pick up a further additive packaging material.

Depending on the design of the transfer means, the additive packaging materials can be transported in a horizontal and/or vertical direction. In this way, the additive packaging materials can be moved along a curved, arc-shaped or straight transport track, for example, by the transfer means. The transport can be accomplished, for example, by a belt, a chain, individual carriers or by the movement of the transfer means as a whole.

In terms of the method, the supply means is first supplied with an additive packaging material continuous belt, which comprises the additive packaging materials in series. The supply means supplies the additive packaging material to a separating organ after the pick-up of the additive packaging material, which separating organ separates the additive packaging material continuous belt and thus separates and individualizes the individual additive packaging materials of the additive packaging material continuous belt. The now individual and separated additive packaging materials are transported away from the separating organ by the supply means and to a transfer means. The transfer means picks up the additive packaging materials at a position spaced from the separating organ at a low speed or, if necessary, also at a speed of zero. The additive packaging materials are then further transported from the transfer means in the direction of an application means, wherein the additive packaging materials are accelerated before delivery to the application means in order to then be delivered from the transfer means to the application means at the higher speed compared to the speed when picking up the additive packaging materials. This higher speed is matched to the speed of the application means, which is moved in order to apply the additive packaging materials to the packages, which are moved via a transport means along a package transport path past the application means and meanwhile receive the separated additive packaging materials.

For ease of understanding and to avoid unnecessary repetitions, the device and the method are described together in the following, without distinguishing in each case in detail between the device and the method. However, given the context, it will be apparent which particular feature is preferred with respect to the device and the method.

In a first particularly preferred embodiment of the device, the supply means is designed to be cyclically drivable for the stepwise transport of the additive packaging material. As the individual additive packaging materials on the additive packaging material continuous belt typically follow at fixed intervals, it makes sense also to perform the supply in time intervals. Thus, a working cycling adapted to the additive packaging materials allows further working processes to be carried out. In this manner, a very precise and reproducible supply of the additive packaging material can be achieved. Alternatively or additionally, in a simpler manner it can be achieved that the separation of the additive packaging material from the additive packaging material continuous belt can be carried out while the continuous belt or the supply means stands still or only moves at a low speed.

If the separating organ is designed to be cyclically drivable, the working steps of separation and supply can be optimally synchronised. In this way, a very precise and reproducible separation of the additive packaging material can be achieved which, as required, can be carried out while the continuous belt or the supply means is stopped or only moves at a low speed. This leads to a disruption free separation of the additive packaging material so that operational disruptions can be kept to a minimum. The cycling of the separating organ may consist in the separating organ being repeatedly moved back and forth in opposite directions. However, the cycling may also preferably be carried out so that the separating organ is held in an end position spaced apart from the additive packaging material continuous belt for a short period of time. It is also particularly expedient for reliability and the performance of the method if the separating organ can be driven cyclically synchronously with the supply means.

Preferably, the supply means is designed as or comprises a rotatable carousel with recesses distributed over the circumference for the transport of the additive packaging material to the separating organ and for relaying the additive packaging material. Frames, also referred to as carousels, which are rotatable about an axis of rotation make it possible to provide recesses distributed, in particular evenly, over the circumference, for the additive packaging material. Thus, the recesses are advantageously designed corresponding to the shape of the additive packaging material so that the recesses can receive in an interlocking manner and expediently hold the additive packaging material. The diameter and the spacing, i.e. the number of recesses applied on the circumference of the carousel can be adapted to the working processes so that the performance and function of the device can be improved. Furthermore, the transport of the additive packaging material can, however, be simply and reliably facilitated, wherein as required assembly space can be saved.

It is constructively advantageous for radial notches to be incorporated between the recesses for receiving the separating organ when separating the additive packaging material so that the separating organ, for example in the form of a cutting blade, can briefly dip into the notch during the separation process and thus can separate the additive packaging material continuous belt while preferably the adjoining additive packaging materials are received in an interlocking manner in the recesses. In this way, it can also be achieved that the additive packaging material continuous belt has a certain pretension, which simplifies the separation of the additive packaging material and improves the quality and safety of the separation.

The application means can alternatively or additionally comprises a drivable application wheel. Using the application wheel, the additive packaging material can be quickly and precisely transported to the application point without increased equipment costs being required. This is in particular the case when the application wheel can be driven at a substantially constant rotational speed. In addition, the reliability of the application is improved when the circumferential speed of the application wheel corresponds at least substantially to the transport speed of the packages along the transport path at the application point. Thus, a low relative speed between the packages and the additive packaging material can be ensured during the application of the latter so that a more process-stable application with less waste is possible. If, in addition, speeds are kept as constant as possible, unwanted forces that result from accelerations are minimised.

In a further advantageous embodiment of the invention, the transfer means comprises a transfer element which can be pivoted at variable speeds and/or a transfer wheel which can be rotated at variable circumferential speeds. Varying speeds of the transfer means adapted to the circumstances improve the robustness of the processes, in particular also when picking up and delivering the additive packaging material with the transfer means. Finally, picking up the additive packaging material can be carried out at a suitable speed of the transfer means and delivering the additive packaging material can be carried out at another suitable speed of the transfer means, for example to optimise the entire process. Thus, particularly advantageously, the carousel and the transfer means are designed such that to deliver the additive packaging material from the carousel to the transfer means, the carousel and the transfer means at least more or less stand still or only move at a low speed. Such a configuration increases process reliability and prevents disruptions when picking up the additive packaging material.

Alternatively or additionally, the transport means can be associated with at least one adhesive application means for gluing the packages supplied to the application means along the package transport path. If the adhesive is applied directly and in a separate method step to the packages, an undesirable sticking of functional groups and assemblies is prevented, thus achieving a stable operation of the device.

In a first particularly preferred embodiment of the method, the supply means and the transfer means are driven cyclically. This means that the supply means and the transfer means each follow similar movement cycles. With respect to the supply means, this may be stopped at regular intervals to effect separation of another additive packaging material from the additive packaging material continuous belt. The same may apply for the transfer means if the pick-up of the additive packaging material is carried out by the transfer means when standing still. Otherwise, the speed of the transfer means can be cyclically increased and reduced again without the transfer means coming to a stop. Alternatively or additionally, the application means preferably moves continuously, in particular at an at least substantially constant speed. The speed is also preferably quite high to allow for a large throughput of packages. This is easily and reliably possible if the application means does not have to be decelerated and accelerated each time between two applications.

If the supply means stands still during the separation of the additive packaging material with the separating organ and/or when relaying the additive packaging material, preferably a separation of an additive packaging material is carried out at at least one still stand of the supply means, in particular every still stand of the supply means. If the pick-up of the additive packaging material from the transfer means is carried out during a slow movement of the supply means, the relaying of the additive packaging material can be carried out respectively shortly before or after the still stand of the supply means, during which time the speed of the supply means is low anyway. Thus, in each case, the operation is simplified and the supply means will not need to be stopped as often.

The transfer means may receive the relayed, separated additive packaging materials directly or indirectly from the supply means. The former is constructively easier to accomplish and can be carried out at a pick-up position, which may be the same for all additive packaging materials. In other words, the supply means may deliver the separated additive packaging materials to the transfer means, wherein the delivery may be carried out while the supply means and the transfer means are moving, in particular rotating. In this case, for the simplicity of the movement, the rotation can be regarded as movement about an axis of rotation. However, the rotation may also be considered as moving along a closed track, wherein the track may be circular, but does not have to be.

In a case that is simple constructively and procedurally, the supply means is formed by a carousel or the supply means comprises a carousel which rotates at a cyclically varying speed about a central axis of rotation. Alternatively or additionally, the transfer means may be designed as a transfer wheel or comprise a transfer wheel. The transfer wheel then preferably rotates about a central axis of rotation at a cyclically varying speed. The axes of rotation are aligned parallel to one another to unify the rotational movement. To be able to reliably carry out the relaying of the additive packaging material, the carousel and the transfer wheel can be moved at least substantially at the same circumferential speed when picking up an additive packaging material so that the additive packaging material has an at least substantially constant speed during the relaying.

Alternatively or additionally, the application means may be or comprise an application wheel. Thus, the application means can be moved at a constant speed without problems by setting the application wheel in constant rotation. The rotation or the circumferential speed of the application wheel is then, in a simple way, at least substantially the same when picking up the additive packaging material and when applying the additive packaging material. As required, the additive packaging materials are thus moved by the application wheel at a constant speed from the pick-up point of the additive packaging material to the application point. To achieve this easily, after the pick-up of an additive packaging material from the supply means, the transfer wheel is accelerated to the circumferential speed of the application wheel. The additive packaging material can then be relayed from the transfer wheel to the application wheel at least substantially without changing the speed.

Essentially and independently of the type of transfer means and application means, it can be provided that the additive packaging materials are delivered from the transfer means to the application means at a speed, in particular a circumferential speed, which at least substantially corresponds to the speed, in particular the circumferential speed, at which the additive packaging materials are applied to the packages. This is simply and reliably possible.

BRIEF DESCRIPTION OF THE DRAWINGS

The invention is explained in more detail in the following with reference to drawings showing an exemplary embodiment, wherein.

DESCRIPTION OF THE INVENTION

Figure 1A:
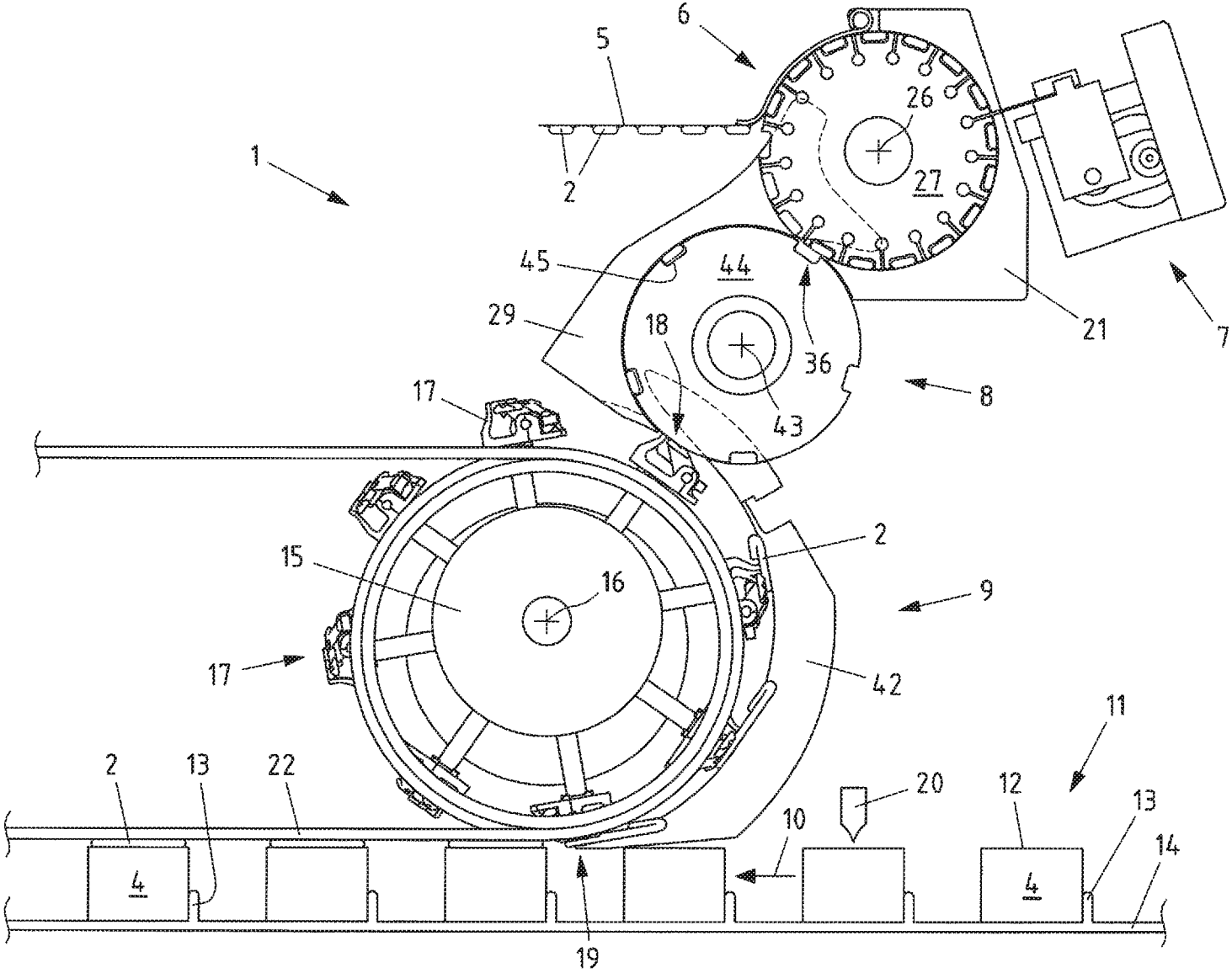
FIG. 1A-C shows a top view of a device according to the invention and a part of an additive packaging material continuous belt for processing with the device and a package with an additive packaging material applied to the package by the device, in each case in a side view.

FIG. 1A shows a device 1 for applying additive packaging material 2 in the form of wrapped straws 3 to previously filled and sealed packages 4 in the form of cardboard composite packages, which here are designed as drinks carton composite packages. The additive packaging materials 2 are pulled into the device 1 from a supply means 6 in the form of an additive packaging material continuous belt 5, which device supplies the additive packaging material continuous belt 5 to a separating device 7. The separating device 7 separates the additive packaging material continuous belt 5 into individual additive packaging materials 2 which are further transported from the supply means 6 to a transfer means 8 from which the additive packaging materials 2 are picked up individually and one after the other. This pick-up of the additive packaging materials 2 is carried out at a low speed of the transfer means 8 or the additive packaging material 2. At other points, the additive packaging materials 2 are delivered from the transfer means 8 to an application means 9, wherein the transfer means 8 is intermittently accelerated so that the delivery of the additive packaging material 2 to the application means 9 is carried out at a significantly higher speed.

The application means 9 applies the additive packaging material 2 relayed from the transfer means 8 to the application means 9 in an application position 19 in series to the packages 4 transported past the application position 19. The transport of the packages 4 along a package transport path 10 and past the application means 9 is carried out using a transport means 11. Thus, the packages 4 are transported by the transport means 11 at a constant speed past the application means 9, in particular the application position 19. For this purpose, the depicted and insofar preferred transport means 11 has a transport belt 14 provided with cams 13 which extends in the transport direction of the packages 4. The individual cams 13 are in interlocking engagement with the packages 4 and move the packages 4 along the application means 9 at defined intervals and at a defined speed.

The application means 9 is designed as an application wheel 1 in the depicted and insofar preferred embodiment which has a plurality of applicators 17 rotating about the axis of rotation 16 of the application wheel 15 and uniformly distributed over the circumference of the application wheel 15. The applicators 17 respectively pick up an additive packaging material 2 at a delivery position 18 and bring it to the application position 19 for it to be applied there to a package 4 transported past.

The connection between the additive packaging material 2 and the package 4 is achieved in the depicted exemplary embodiment by an adhesive bond, although other connections are also conceivable. Hot glue is used as the adhesive which is applied pointwise to the sides 12 of the packages 4 by adhesive application means 20, in particular in the form of adhesive application nozzles, arranged on a package transport path 10. At the application position 19, an additive packaging material 2 is respectively pressed into the hot glue points. To hold the additive packaging material 2 applied in this way in position and to provide the hot glue with a certain setting time, a pressure belt 22 presses the freshly applied additive packaging materials 2 against the packages 4 immediately from the application position 19 over a certain distance while the packages 4 are transported further.

Figure 1C:
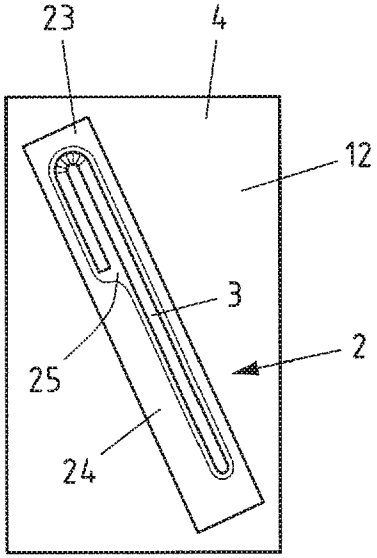
Figure 1B:
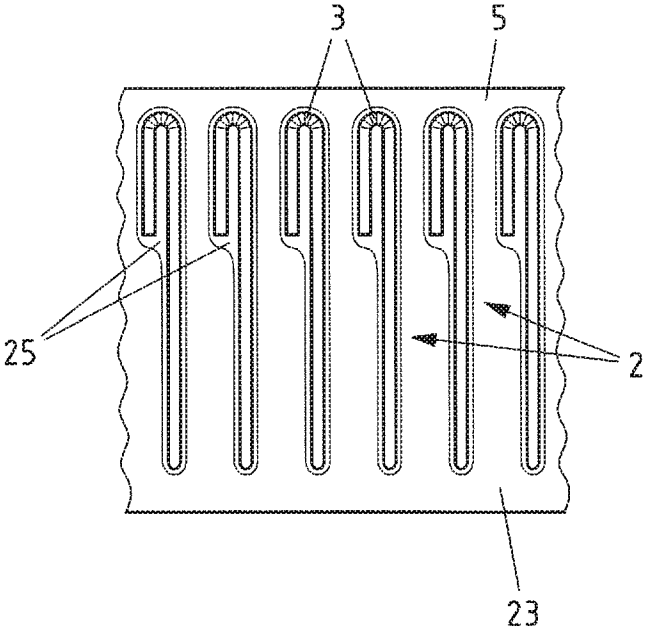

The additive packaging materials 2 are supplied to the device 1 in the form of an additive packaging material continuous belt 5, which is partially depicted in more detail in FIG. 1B, and applied to packages 4 after separation. The additive packaging materials 2 are composed of a straw 3 and two films 23. There are various different forms of straws 3, however, in particular at least partially U-shaped or I-shaped straws 3 are referred to. The depicted and insofar preferred additive packaging material continuous belt 5 comprises U-shaped straws 3. The films 23 are sealed at their edges 24 and form a pouch 25 therebetween in which the straw 3 is received. In other words, the straw 3 is wrapped in film 23. The additive packaging material continuous belt 5 is formed by a succession of additive packaging materials 2, wherein respectively the films of adjacent additive packaging materials 2 are connected to one another. In the depicted and insofar preferred additive packaging material continuous belt 5, the straws 3 are received between two films extending along the entire additive packaging material continuous belt 5. In other words, the additive packaging material continuous belt 5 is a "continuous" sequence of additive packaging material units. A package 4 with an additive packaging material 2 which is applied thereto and separated from the additive packaging material continuous belt 5 is depicted as an example in FIG. 1C. The additive packaging material 2 is applied somewhat diagonally to the associated side 12 of the package 4, however, this does not necessarily has to be the case.

The depicted and insofar preferred packages 4 comprise a flowable foodstuff, in particular a drink. In addition, the package 4 is a cardboard composite package, thus a drinks carton composite package. The packaging is formed of a packaging laminate which comprises layers made of different packaging materials, specifically at least cardboard and plastic. The plastic layers are provided on the outer sides of the packaging laminate and formed by thermoplastic materials, in particular polyethylene (PE). By folding and sealing the packaging laminate, the package 4 is formed and sealed. As required, the packaging laminate is printed with a decor on one side.

Figure 2:
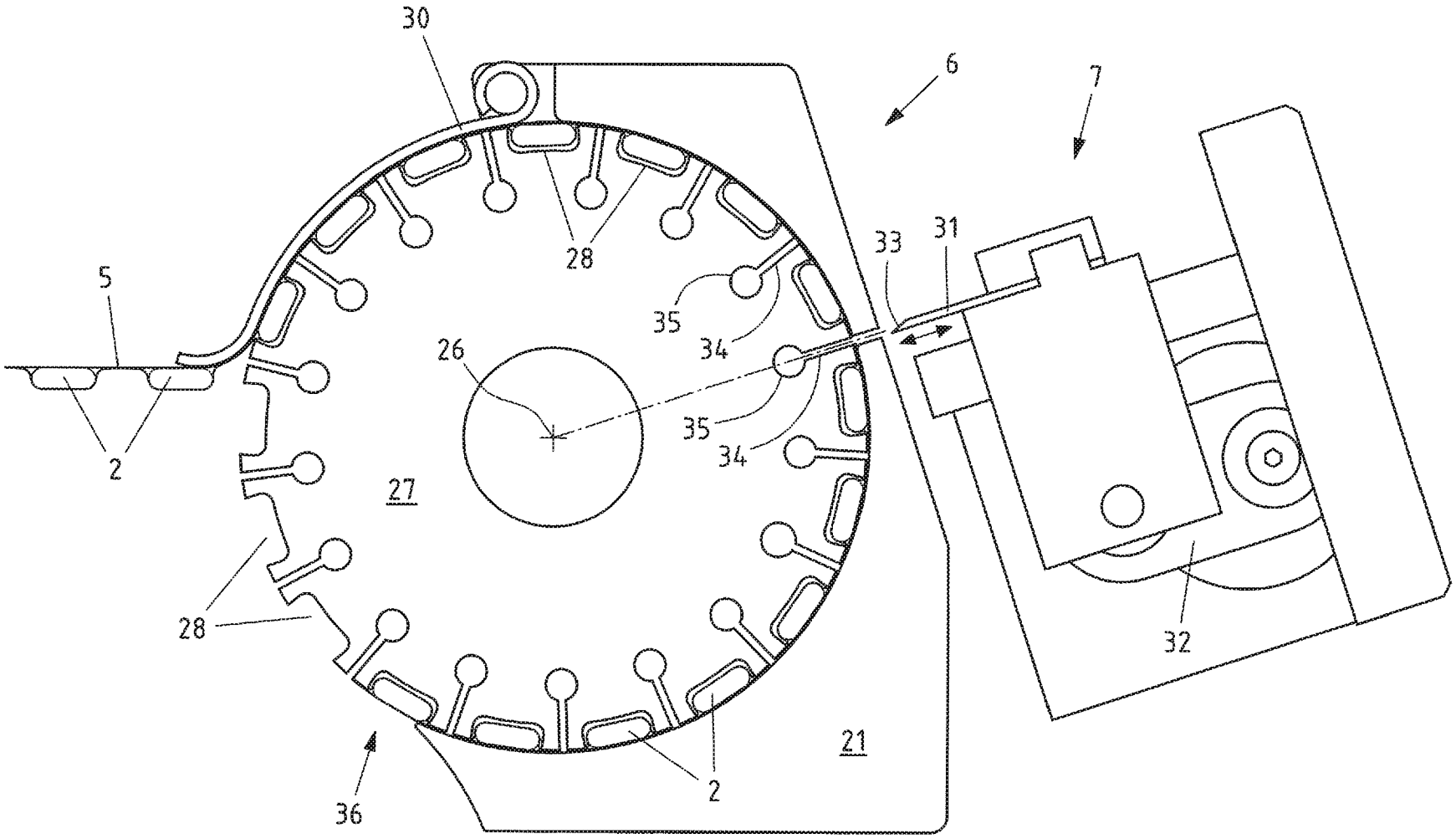
FIG. 2 shows a supply means of the device from FIG. 1A comprising a separating organ in top view.

A detail of the device 1 from FIG. 1A comprising the supply means 6 is depicted in FIG. 2. The supply means 6 comprises a carousel 27 which rotates in a clockwise direction about a central axis of rotation 26, which carousel has recesses 28 distributed over its circumference for partially receiving 28 the additive packaging material 2. The recesses 28 are modelled to the shapes of the straws 3 so that the straws 3 and thus the additive packaging materials 2 are held in an interlocking manner in the recesses 28. So that the additive packaging materials 2 remain in the recesses 28, a fixed side wall 21 is provided circumferentially. In the area of the entry of the additive packaging material continuous belt 5 from the supply means 6, a torsion spring-loaded clamping plate 30 is provided which circumferentially guides the additive packaging material continuous belt 5 and presses it against the carousel 27 and the recesses 28. The clamping plate 30 merges into the side wall 21 seen in the transport direction of the additive packaging material continuous belt 5. If a new additive packaging material continuous belt 5 is to be inserted, the clamping plate 30 can be pivoted outwards and locked to facilitate the insertion of the additive packaging material continuous belt 5. The depicted an insofar preferred supply means 6 is formed by the carousel 27 with the recesses 28, the side wall 21 and the clamping plate 30.

The supply means 6 is associated with a separating device 7 for separating the additive packaging material 2 from the additive packaging material continuous belt 5 using a separating organ 31. In the depicted and insofar preferred device 1, the separating organ 31 is radially moved back and forwards with a drive mechanism 32 at least substantially in the direction of the axis of rotation 26 of the carousel 27, as is indicated by the double arrow. The separating organ 31 is designed as a sharpened cutting blade on the edge 33 associated with the additive packaging material continuous belt 5 and cuts through the additive packaging material continuous belt 5 in the connecting area of two successive additive packaging materials 2, whereby the additive packaging materials 2 of the additive packaging material continuous belt 5 are successively separated or individualized from one another. In this case, the separating organ 31 engages at least partially in notches 34 arranged along the circumference of the carousel 27 between the recesses 28 for the additive packaging materials 2.

The carousel 27 works in a cyclical operation in which the carousel 27 is stopped in cycles and is further rotated about a circumferential segment which corresponds to the width of an additive packaging material 2. For this purpose, the carousel 27 is synchronised with the drive mechanism 32 of the separating device 7 so that when the carousel 27 stands still, the separating organ 31 is moved in the direction of the axis of rotation 26 of the carousel 27 forward and back into the starting position. When moving the separating organ 31 forwards, the separating organ 31 separates the additive packaging material continuous belt 5 in the region of the associated notch 34. Once the separating organ 31 is again out of engagement with the notch 34, in particular again returned to the starting position, the carousel 27 rotates in another cycle to the next position, whereby the separating organ 31 faces the next notch 34 and the next additive packaging material 2 can be separated from the additive packaging material continuous belt 5 by a forwards movement. The separating device 7 is arranged fixed on the supply means 6 and only the separating organ 31 moves forth and back and in a linear and in relation to the carousel 27 radial movement. A cyclic movement of the separating organ 31 in the circumferential direction does not occur with the depicted and insofar preferred separating organ 31.

In order to be able to receive and/or remove smaller cutting residues, such as cutting burrs, or to provide a sufficient ventilation and/or aeration, the notches 34 terminate radially in vertically extending emptying channels 35 which have a cross-section which is larger than the width of the notches 34 adjacent to the emptying channels 35. The additive packaging materials 2 separated in the described way are transported further with each further cycle of the supply means 6 in the direction of a pick-up position 36 from which the additive packaging materials 2 are delivered to the transfer means 8 and picked up from the transfer means 8.

Figure 3:
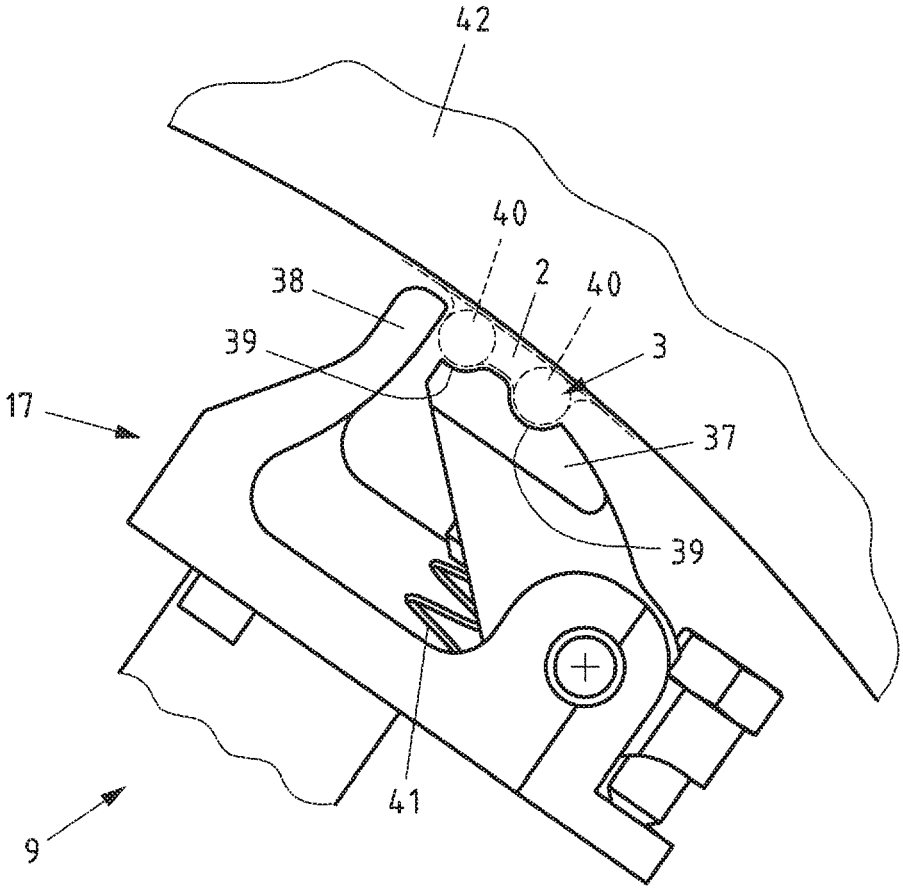
FIG. 3 shows a detail of an application means of the device from FIG. 1A in top view.

A detail of the application means 9 comprising an applicator 17 is depicted in FIG. 3. The outer part of the applicator 17, which moves the additive packaging material 2 from the delivery position 18 to the application position 19, comprises an application finger 37 and a guide finger 38. The application finger 37 comprises two grooves 39 on the front side which correspond to the shape of the additive packaging material 2, in particular the straw 3. The two grooves 39 are used to hold the two legs 40 of the U-shaped straw 3 as is depicted by an additive packaging material together with a straw 3 marked with a dashed line. When using straight, i.e. I-shaped, straws 3, generally one groove 39 would be sufficient. The application finger 37 can be slightly pivoted against the spring force of a spring 41 and is configured so that the additive packaging material 2 is clamped and thus securely guided between the delivery position 18 and the application position 19 between the application finger 37, the guide finger 38 and a side belt 42 provided circumferentially on the application wheel 15. The guide finger 38 thus prevents the additive packaging material 2 from becoming disengaged from the application finger 37 in the circumferential direction.

The side belt 42 ends shortly before the application position 19, as is depicted in FIG. 1A, so that the additive packaging material 2 is pressed into the hot glue of the package 4 moved past by the spring force of the spring 41. The depicted application wheel 15 also has movement mechanism (not described here in detail) which allows pivoting the additive packaging materials 2 about a radial axis between the delivery position 18 and the application position 19 such that the additive packaging materials 2 can be picked up in the delivery position 18 parallel to the axis of rotation 16 of the application wheel 15 and applied diagonally to the associated side 12 of the associated package 4, as is depicted in FIG. 1C.

The application wheel 15 rotates in the shown and insofar preferred exemplary embodiment at such a constant angular or circumferential speed such that the additive packaging materials 2 or applicators 17 have a circumferential speed at the front side at the application position 19 which corresponds in magnitude and direction at least approximately to the speed of the packages 4 at the application position 19. Such an operation minimises the relative speeds between the package 4 and additive packaging material 2 during application.

Figure 4:
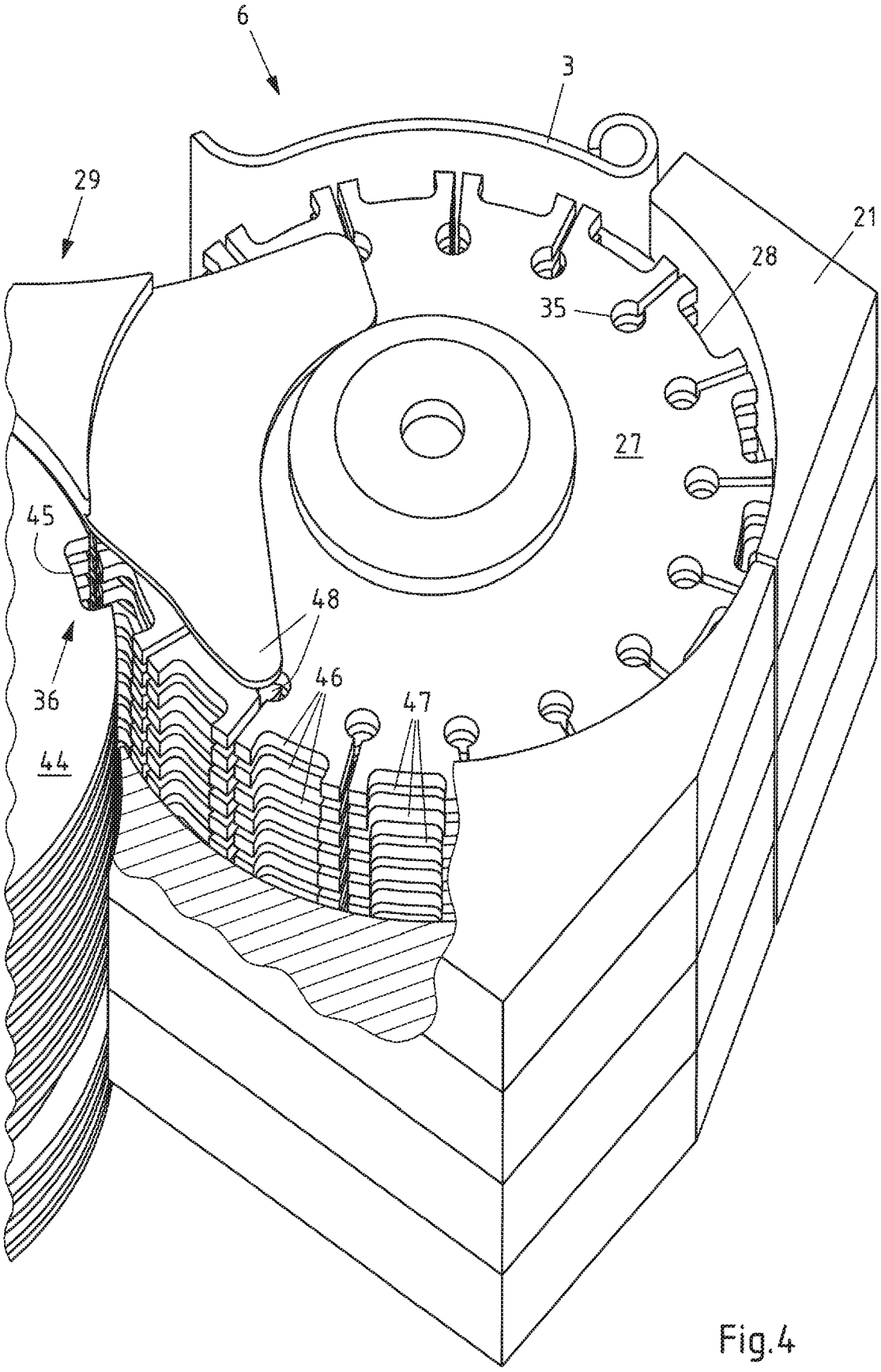
FIG. 4 shows a detail of the device from FIG. 1A in the region of a pick-up position of a transfer means in a perspective representation.

A transfer means 8 with a transfer wheel 44 rotatable about an axis of rotation 43 and a further side wall 29 provided circumferentially is provided between the application means 9 and the supply means 6, as is depicted in detail in FIG. 4. The transfer wheel 44 comprises elongated receiving grooves 45 for receiving the additive packaging materials 2 which are distributed uniformly over the circumference of the transfer wheel 44. However, for improved clarity, the additive packaging materials 2 and the additive packaging material continuous belt 5 are not depicted. The additive packaging materials 2 are guided between the transfer wheel 44 and the fixed further side wall 29 and are transported in the circumferential direction by the interlocking between the receiving grooves 45 and the additive packaging material 2. In the pick-up position 36 the transfer means 8 picks up the relayed additive packaging material 2 from the carousel 27 and accelerates the additive packaging material 2 between the pick-up position 36 and the delivery position 18 to a speed adapted to the application wheel 15 and delivers the additive packaging material 2 to an applicator 17 of the application wheel 15 at the delivery position 18.

In addition to the supply means 6, the part of the transfer means 8 is depicted which is located in the region of the pick-up position 36 of the additive packaging material 2 from the carousel 27 to the transfer wheel 44 of the transfer means 8. The carousel 27 is formed by a plurality of stacked and spaced-apart plate elements 46 so that a plurality of intermediate levels 47 are formed between the plate elements 46. A plurality of fixed combing lamellas 48 protrude as extensions of the further side wall 21 into these intermediate levels 35. The combing lamellas 48 combined form a sectional guide when guiding the additive packaging material 2 out of the recesses 28 of the carousel 27 so that with the further side wall 21 the additive packaging material 2 is continuously guided during the pick-up of the additive packaging material 2 into the receiving grooves 45 of the transfer wheel 44 from the recesses 2 of the carousel 27.

During the delivery of the additive packaging material 2, the transfer wheel 44 has in the region of the receiving grooves 45 an approximately equal, albeit low, circumferential speed to the carousel 27 in the region of the recesses 28 so that the additive packaging materials 2 can be relayed at least substantially without accelerating from the supply means 6 to the transfer means 8. The transfer wheel 44 is further rotated and in particular accelerated from the point in time at which the additive packaging material 2 is picked up and guided between the transfer wheel 44 and the further side wall 29.

Figure 5:
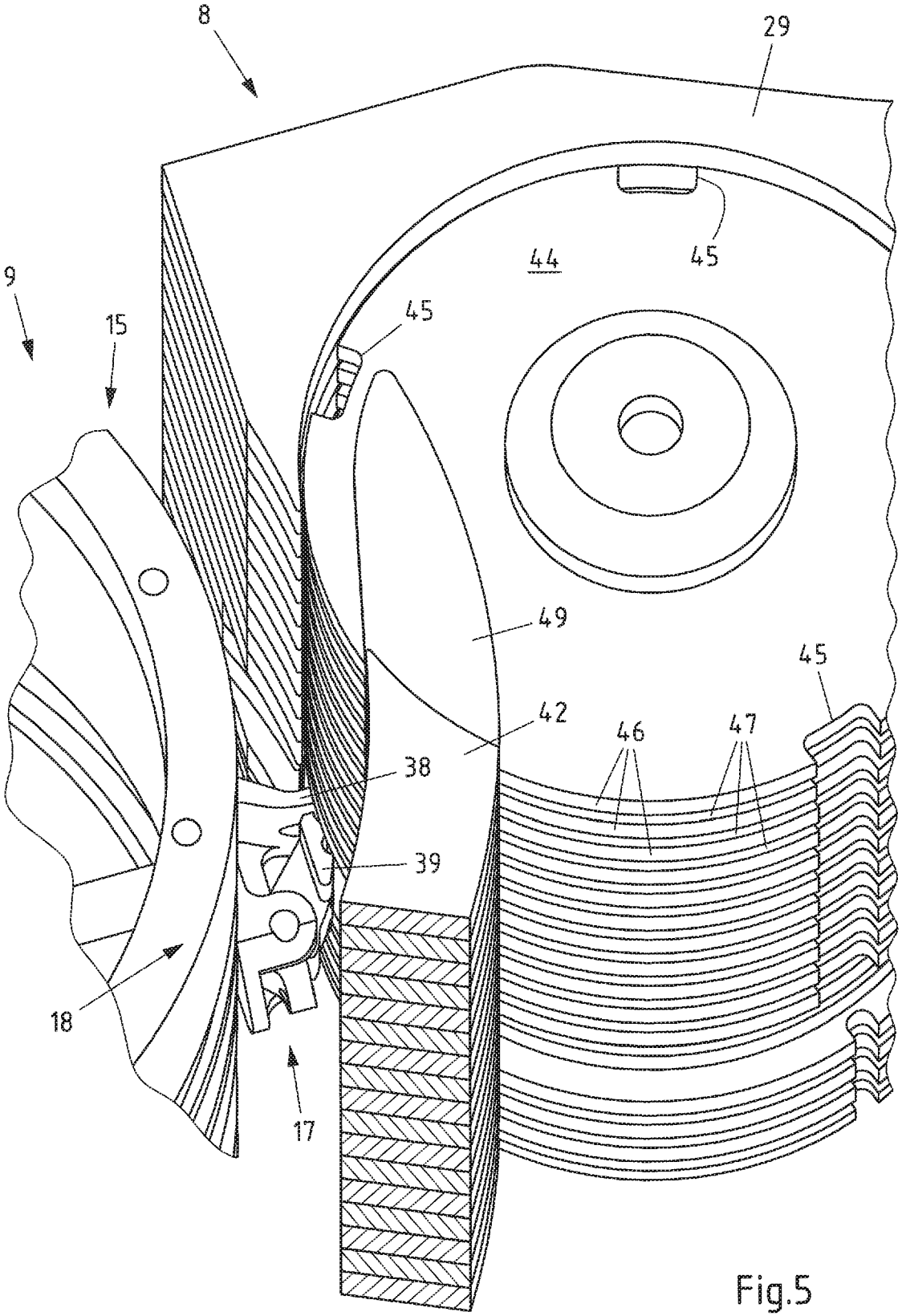
FIG. 5 shows a detail of the device from FIG. 1A in the region of a delivery position of a transfer means in a perspective representation.

In FIG. 5, in which for the sake of clarity, the additive packaging materials 2 are also not depicted, the transfer means 8 and the application means 9 are depicted in the region of the delivery position 18. The transfer wheel 44 is constructed in a similar way to the carousel 27, specifically from a plurality of plate elements 46, which in turn also form intermediate levels 47, into which the plurality of combing lamellas 49 protrude as a continuation of the side belt 42. This facilitates the combing of the additive packaging material 2 from the receiving grooves 45 of the transfer wheel 44 in the region of the delivery position 18.

When delivering the additive packaging material 2 from the transfer means 8 to the application means 9, the transfer wheel 44 and the applicator wheel 15 have at least approximately the same circumferential speeds. After the delivery, the additive packaging material 2 is held by the application finger 37 and by the guide finger 38. During further rotation of the application wheel, the additive packaging material 2 is completely combed out of the receiving groove 45 by the combing lamellas 49 and during further rotation the additive packaging material 2 is guided by the side belt 42 and pressed onto the side 42. The additive packaging materials 2 are transported by the application wheel 15 from the delivery position 18 into the application position 19 at a constant speed and thus pivoted about a radial axis. In the application position 19, the additive packaging material 2 is then applied obliquely to the package 4 transported past.

LIST OF REFERENCE SIGNS

1 Device
2 Additive packaging material

3 Straws
4 Packages
5 Additive packaging material continuous belt
6 Supply means
7 Separating device
8 Transfer means
9 Application means
10 Package transport path
11 Transport means
12 Package side
13 Cams
14 Transport belts
15 Application wheel
16 Axis of rotation
17 Applicator
18 Delivery position
19 Application position
20 Adhesive application means
21 Side wall
22 Pressure belt
23 Film
24 Edge
25 Pouch
26 Axis of rotation
27 Carousel
28 Recesses
29 Side wall
30 Clamping plate
31 Separating organ
32 Drive mechanism
33 Edge
34 Notch
35 Emptying channel
36 Pick-up position
37 Application finger
38 Guide finger
39 Groove
40 Leg
41 Spring
42 Side belts
43 Axis of rotation
44 Transfer wheel
45 Receiving groove
46 Plate element
47 Intermediate level
48 Combing lamella
49 Combing lamella

The invention claimed is:

1. A device for separately applying additive packaging materials, supplied as an additive packaging material continuous belt, to packages, the device having a separating organ for separating the additive packaging materials of the additive packaging material continuous belt, a supply section comprising a carousel which rotates about a central axis for supplying the additive packaging material continuous belt to the separating organ and for relaying the additive packaging materials separated by the separating organ, an application section consisting of an application wheel with an applicator rotating about an axis of rotation for applying the separated additive packaging materials to the packages, and a transport section comprising a transport belt provided with cams for transporting the packages along a package transport path to the application section, wherein a transfer section comprising a transfer wheel rotatable about a central axis is provided for picking up the additive packaging materials relayed by the supply section and for rotationally accelerating the picked up additive packaging materials to a speed adapted to the application section in such a way that the transfer section delivers the additive packaging materials to the application section at a circumferential speed which corresponds to a speed at which the additive packaging materials are applied to the packages.

2. The device according to claim 1, wherein the supply section is for stepwise transport of the additive packaging materials and is designed to be cyclically drivable.

3. The device according to claim 1, wherein the separating organ is designed to be cyclically drivable synchronously with the supply section.

4. The device according to claim 1, wherein the carousel has recesses distributed over its circumference for transport of the additive packaging materials to the separating organ and for relaying the additive packaging materials.

5. The device according to claim 4, wherein radial notches are incorporated between the recesses for receiving the separating organ during separation of the additive packaging materials.

6. The device according to claim 1, wherein the application wheel is drivable at a circumferential speed corresponding to a transport speed of the packages.

7. The device according to claim 1, wherein the transfer wheel can be rotated at variable circumferential speeds.

8. The device according to claim 7, wherein the additive packaging materials are transferred from the carousel of the supply section to the transfer wheel of the transfer section at a pick-up position while the carousel and the transfer wheel move at the same speed.

9. The device according to claim 1, wherein the transport section is associated with at least one adhesive application section for gluing the packages supplied to the application section along the package transport path.

10. A method for separately applying additive packaging materials, supplied in an additive packaging material continuous belt, to packages, using the device according to claim 1, the method comprising the steps of:

supplying an additive packaging material continuous belt to the separating organ by means of the supply section, separating additive packaging materials of the additive packaging material continuous belt on the supply section by means of the separating organ, relaying the separated additive packaging materials by means of the supply section, picking up and rotationally accelerating the separated additive packaging materials to a speed adapted to the application section by means of the transfer section, delivering the accelerated additive packaging materials from the transfer section to the application section at a circumferential speed corresponding to a speed at which the additive packaging materials are applied to packages, and applying the additive packaging materials by means of the application section to packages moved past the application section along a package transport path by the transport section.

11. The method according to claim 10, wherein the supply section and the transfer section are driven cyclically, and/or in wherein the application section is driven continuously constant speed.

12. The method according to claim 10, wherein the supply section stands still when separating the additive packaging materials using the separating organ and/or when relaying the additive packaging materials.

13. The method according to claim 10, wherein the transfer section picks up the separated additive packaging materials directly from the supply section at a pick-up position, and/or wherein the transfer section directly delivers said separated additive packaging materials to the application section at a delivery position, and/or wherein the additive packaging materials are relayed from the carousel of the supply section to the transfer wheel of the transfer section by rotating the carousel and the transfer wheel, and/or wherein the additive packaging materials are relayed from the transfer wheel of the transfer section to the application wheel of the application section by rotating the transfer wheel and the application wheel.

14. The method according to claim 10, wherein the application wheel rotates at a constant speed for picking up and applying the additive packaging materials and wherein the additive packaging materials, by means of the transfer section, are accelerated to a circumferential speed of the application section until the delivery of the additive packaging materials to the application section.

15. The method according to claim 10, wherein the circumferential speed at which the additive packaging materials are delivered from the transfer section to the application section corresponds to a circumferential speed at which the additive packaging materials are applied to the packages.

* * * * *